US008401449B2

(12) United States Patent
Condello et al.

(10) Patent No.: US 8,401,449 B2
(45) Date of Patent: Mar. 19, 2013

(54) APPARATUSES USEFUL IN PRINTING AND METHODS OF FIXING MARKING MATERIALS ONTO MEDIA

(75) Inventors: Anthony S. Condello, Webster, NY (US); Bin Zhang, Penfield, NY (US)

(73) Assignee: Xerox Corporation

( * ) Notice: Subject to any disclaimer, the term of this patent is extended or adjusted under 35 U.S.C. 154(b) by 475 days.

(21) Appl. No.: 12/693,517

(22) Filed: Jan. 26, 2010

(65) Prior Publication Data

US 2011/0182633 A1 Jul. 28, 2011

(51) Int. Cl.
*G03G 15/00* (2006.01)
*G03G 15/20* (2006.01)

(52) U.S. Cl. ..... 399/331; 399/122; 399/328; 399/333

(58) Field of Classification Search ..... 399/67, 399/68, 122, 322, 328, 330–333
See application file for complete search history.

(56) References Cited

U.S. PATENT DOCUMENTS 5,195,430 A * 3/1993 Rise ..... 100/168
6,636,718 B2 * 10/2003 Yura et al. ..... 399/333
7,251,447 B2 * 7/2007 Kanamori et al. ..... 399/333
2008/0037069 A1 2/2008 Mestha et al.
2008/0247797 A1 * 10/2008 Yoshino et al. ..... 399/406

* cited by examiner

*Primary Examiner* — Walter L Lindsay, Jr.
*Assistant Examiner* — Jessica L Eley
(74) *Attorney, Agent, or Firm* — Ellis B. Ramirez; Richard A. Castelano; Ronald E. Prass, Jr.

(57) ABSTRACT

Apparatuses useful in printing and methods of fixing marking materials onto media are disclosed. An exemplary apparatus useful in printing includes a first roll including a first shaft and a first surface; a second roll including an axially-extending inner portion including a second shaft; an axially-extending outer portion over the inner portion; at least a first annular gap and a second annular gap extending axially between the inner portion and the outer portion, the first annular gap being axially spaced from the second annular gap; and a second surface forming a nip with the first surface. The inner portion and the outer portion of the second roll bend in opposite directions when the first roll and the second roll are loaded by applying a first force to the first shaft in a first direction and applying a second force to the second shaft in a second direction opposite to the first direction.

16 Claims, 6 Drawing Sheets

APPARATUSES USEFUL IN PRINTING AND METHODS OF FIXING MARKING MATERIALS ONTO MEDIA

BACKGROUND

Some printing apparatuses include opposed rolls that form a nip. In such apparatuses, media are fed to the nip and contacted by the rolls to fix marking material onto the media.

It would be desirable to provide apparatuses useful in printing and associated methods that utilize rolls to fix marking materials onto media with more desirable image quality.

SUMMARY

Apparatuses useful in printing and methods of fixing marking materials onto media are disclosed. An exemplary embodiment of the apparatuses useful in printing comprises a first roll comprising a first shaft and a first surface; a second roll comprising an axially-extending inner portion including a second shaft; an axially-extending outer portion over the inner portion; at least a first annular gap and a second annular gap extending axially between the inner portion and the outer portion, the first annular gap being axially spaced from the second annular gap; and a second surface forming a nip with the first surface. The inner portion and the outer portion of the second roll bend in opposite directions when the first roll and the second roll are loaded by applying a first force to the first shaft in a first direction and applying a second force to the second shaft in a second direction opposite to the first direction.

DRAWINGS

DETAILED DESCRIPTION

Figure 1:
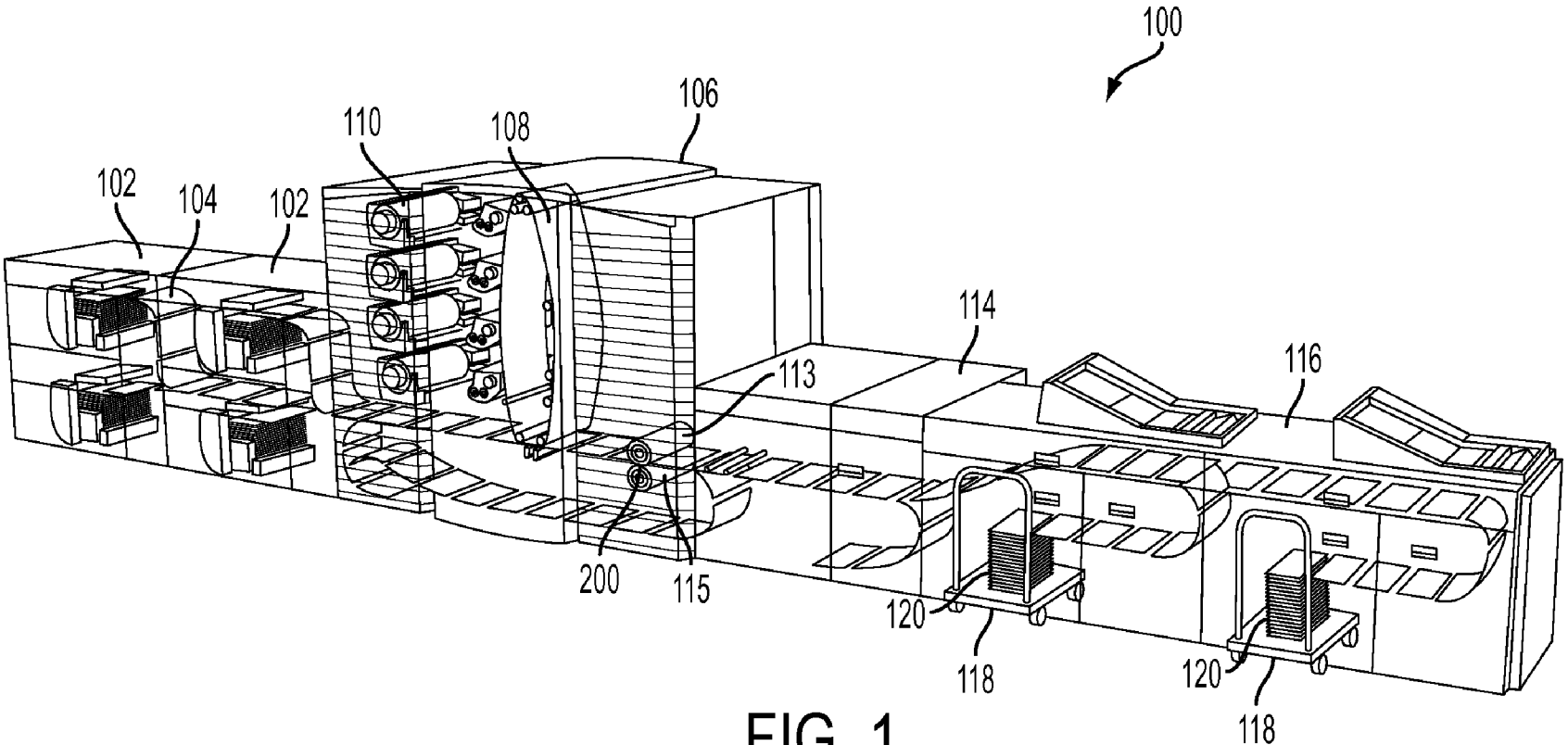
FIG. 1 depicts an exemplary embodiment of a printing apparatus.

The disclosed embodiments include apparatuses useful in printing. An exemplary embodiment of the apparatuses comprises a first roll comprising a first shaft and a first surface; a second roll comprising an axially-extending inner portion including a second shaft; an axially-extending outer portion over the inner portion; at least a first annular gap and a second annular gap extending axially between the inner portion and the outer portion, the first annular gap being axially spaced from the second annular gap; and a second surface forming a nip with the first surface. The inner portion and the outer portion of the second roll bend in opposite directions when the first roll and the second roll are loaded by applying a first force to the first shaft in a first direction and applying a second force to the second shaft in a second direction opposite to the first direction.

Another exemplary embodiment of the apparatuses useful in printing comprises a first roll comprising a first shaft and a first surface; a second roll comprising a second shaft including a first end and a second end; at least a first bearing and a second bearing mounted to the second shaft at axially spaced locations between the first end and second end; an outer sleeve overlying the second shaft and supported by the first bearing and second bearing; at least a first annular gap and a second annular gap extending axially between the second shaft and the outer sleeve, the second annular gap being axially spaced from the first annular gap; and a second surface forming a nip with the first surface. The second shaft and the outer sleeve bend in opposite directions when the first roll and the second roll are loaded by applying a first force to the first shaft in a first direction and applying a second force to the second shaft in a second direction opposite to the first direction.

The disclosed embodiments further include methods of fixing marking materials onto media in an apparatus useful in printing. In an exemplary embodiment, the apparatus comprises a first roll comprising a first shaft and a first surface, a second roll comprising an axially-extending inner portion including a second shaft, an axially-extending outer portion over the inner portion, at least a first annular gap and a second annular gap extending axially between the inner portion and the outer portion, the first annular gap being axially spaced from the second annular gap, and a second surface forming a nip with the first surface. The method comprises loading the first roll and the second roll by applying a first force to the first shaft in a first direction and applying a second force to the second shaft in a second direction opposite to the first direction, wherein the inner portion and the outer portion of the second roll bend in opposite directions; and feeding a medium having marking material thereon to the nip of the apparatus and fixing the marking material onto the medium.

As used herein, the term "printing apparatus" can encompass any apparatus that performs a print outputting function for any purpose. Such apparatuses can include, e.g., printers, copiers, facsimile machines, bookmaking machines, multifunction machines, and the like.

FIG. 1 illustrates an exemplary printing apparatus 100, as disclosed in U.S. Patent Application Publication No. 2008/0037069, which is incorporated herein by reference in its entirety. The printing apparatus 100 can be used to produce prints from various types of media of different sizes and weights. The printing apparatus 100 includes two media feeder modules 102 arranged in series, a printer module 106 adjacent the media feeder modules 102, an inverter module 114 adjacent the printer module 106, and two stacker modules 116 arranged in series adjacent the inverter module 114.

In the printer module 106, marking material (toner) is transferred from a series of developer stations 110 to a charged photoreceptor belt 108 to form toner images on the photoreceptor belt and produce prints. The toner images are transferred to one side of media 104 fed through the paper path. The media are advanced through a fixing device 200 including a fixing roll 113 and a pressure roll 115. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

In the fixing device 100, the fixing roll 113 and the pressure roll 115 of the fixing device 200 are positioned in contact with each other to form a nip. At the nip, a combination of heat and pressure can be applied to media on which marking material has been applied to fix the marking material.

In fixing devices including opposed rolls forming a nip, the rolls deflect when they are loaded to form a nip. When the fixing roll and pressure roll have a uniform outer circumference along the cross-process (axial) direction of the rolls, this roll deflection results in a non-uniform nip width along the cross-process direction of the rolls in the loaded state. The nip can be narrower in the axial central region of the rolls and wider at the opposed ends of the rolls.

The deflection of rolls in fixing devices can result in significant negative effects on nip pressure uniformity along the roll axes. This nip pressure non-uniformity can cause poor or differential fix/gloss and media wrinkling.

It has been noted that it is generally less difficult to reduce nip width non-uniformity in the cross-process direction when the rolls of the fixing devices have softer outer surfaces and are actively heated. It has further been noted that the problems associated with nip-width non-uniformity can be more severe in fixing devices that include rolls with hard outer surfaces and are not actively heated. When such rolls are subjected to high loads (e.g., >1000 lbs.) with insufficient/no elastic outer coatings on the rolls to absorb the loads, small dimensional variations in the nip width can produce large differences in the nip pressure along the axial (cross-process direction). A non-uniform nip width typically produces non-uniform fixing of marking material in the cross-process direction, as well as waviness or wrinkling of media fed to the nip.

In order to try to reduce the degree of nip width non-uniformity in fixing devices including opposed rolls forming a nip, each of the opposed rolls can be profiled (crowned or flared) to have a larger outer circumference at its axial central region than at its opposed ends, and/or the roll axes can be skewed relative to each other. Although these techniques may provide a substantially uniform nip width, the non-uniform outer circumferences of the rolls can cause various problems, such as wrinkling of media fed to the nip. Wrinkling can occur in profiled rolls due to the differential roll outer surface velocity from the center (having the largest circumference) axially to the ends of the rolls (having the smallest circumference) due to a variation in the circumference of the rolls in the axial direction.

In light of these and other considerations, apparatuses useful in printing and methods of fixing marking materials onto media in apparatuses useful in printing are provided. Embodiments of the apparatuses include a fixing device with rolls constructed to mitigate negative effects of roll bending. In the fixing devices, the rolls are constructed to bend in a manner, when loaded, to allow a more uniform nip width to be achieved without the need to profile the outer surfaces of the rolls or skew the rolls. Problems, such as media wrinkling, associated with profiling and skewing can be avoided. Not skewing the rolls also relaxes the roll alignment tolerances in the fixing devices. Embodiments of the fixing devices can provide desirable roll stiffness, substantially constant axial roll circumference (axial surface speed), and reduced axial nip width and pressure variation.

Figure 2:
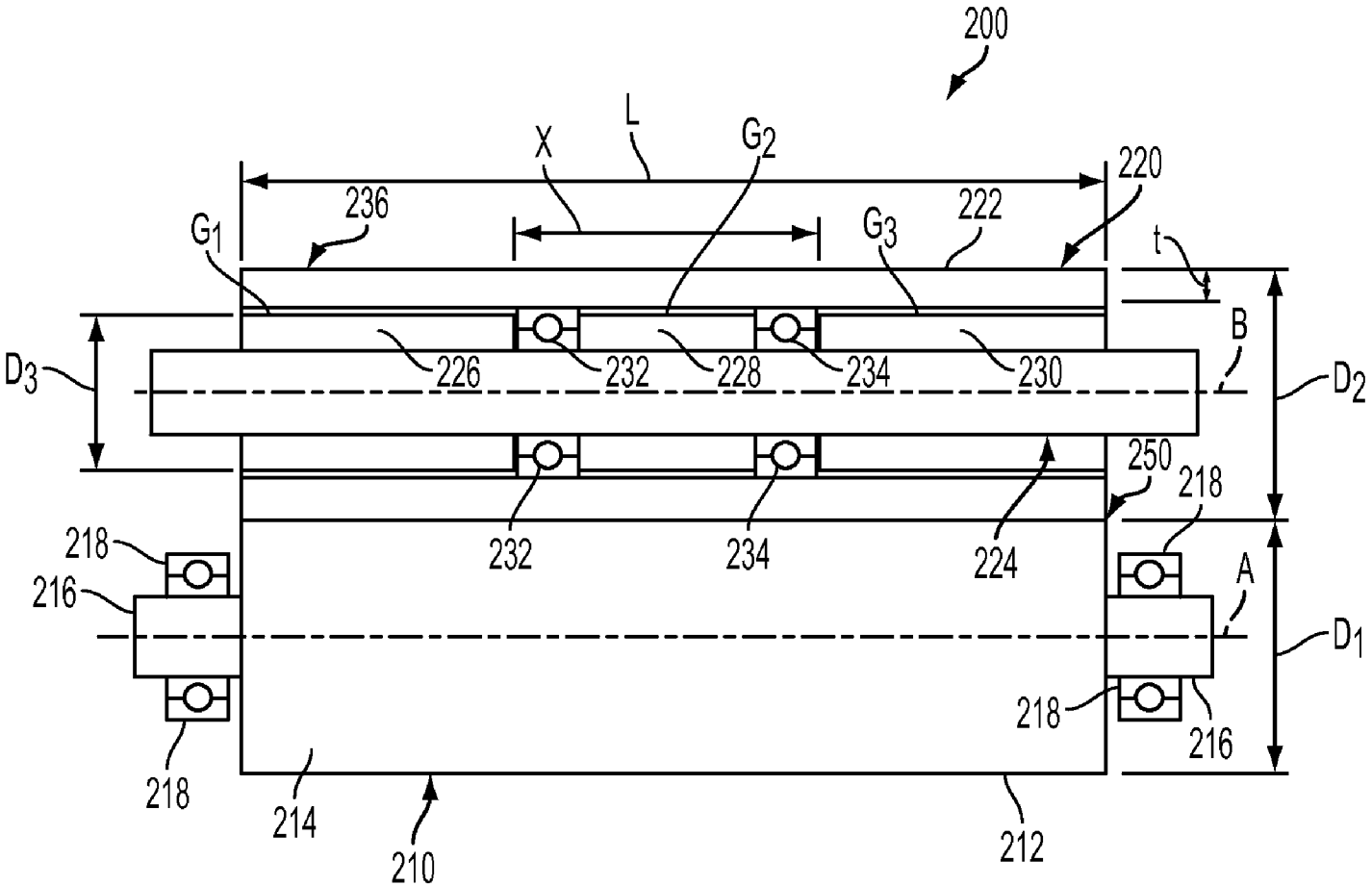
FIG. 2 depicts an exemplary embodiment of an apparatus useful in printing including a fixing device with rolls.

FIG. 2 illustrates an exemplary embodiment of an apparatus useful in printing including a fixing device 200. As shown, the fixing device 200 includes a first roll 210 and a second roll 220. In embodiments, the first roll 210 is the drive roll and the second roll 220 is driven by contact with the first roll 210 and media. The first roll 210 includes an outer surface 212 and the second roll 220 includes an outer surface 222. The outer surfaces 212 and 222 form a nip 250 to which media are fed to fix marking material onto the media. FIG. 2 depicts the fixing device 200 from a direction substantially along the process direction of media fed to the nip 250. FIG. 2 shows the first roll 210 and the second roll 220 in an un-loaded state.

In embodiments, the first roll 210 can be either a non-conformable roll (i.e., hard roll) or a conformable roll. When the first roll 210 is a non-conformable roll for high-pressure conditions at the nip 250, the first roll 210 is constructed so that the outer surface 212 is not depressed by contact with the second roll 220 during operation of the fixing device 200. In these embodiments, the body 214 of the first roll 210 can comprise any suitable hard material, such as metals and ceramics. For example, the body 214 can be made from a single piece of the material. In other embodiments, the body 214 can include a solid core and one or more layers, such as one or more ceramic layers, over the core. The one or more layers can be in the form of cylindrical sleeves and/or coatings, for example. The core and overlying layer(s) can comprise different materials. As shown, the body 214 is cylindrical and has an outer diameter, $D_1$. In embodiments, the outer diameter $D_1$ can be constant along the axial length of outer surface 212.

Embodiments of the first roll 210 that are conformable for relatively lower pressure conditions at the nip 250 can include one or more elastomeric layers. For example, the first roll 210 can comprise a solid core, such as a metal core, and one or more layers of an elastomeric material, such as silicone rubber, or the like, overlying the core. A release layer comprising polytetrafluoroethylene (Teflon®), a fluoroelastomer sold under the trademark Viton® by DuPont Performance Elastomers, L.L.C., or the like, can be provided over the elastomeric material(s) and form the outer surface 212 of the first roll 210.

As shown, the first roll 210 includes a journal 216 at each axial end. A bearing 218 is mounted to each respective journal 216. The first roll 210 is supported (loaded) in the fixing device 200 by forces applied at the journals 216.

Embodiments of the fixing device 200 may not include a thermal energy source that actively heats the outer surface 212 of the first roll 210. In such embodiments, the fixing device 200 does not include an internal thermal energy source inside the first roll 210 or an external thermal energy source external to the first roll 210 for heating the outer surface 212.

In other embodiments of the fixing device 200, the first roll 210 can be internally and/or externally heated. For example the first roll 210 can include one or more internal heating elements (not shown), such as axially-extending heat lamps. The first roll 210 can alternatively or additionally be externally heated by, e.g., one or more external heater rolls (not shown) positioned in thermal contact with the outer surface 212, by radiation and/or by convection.

The illustrated second roll 220 includes a shaft 224 and stiffener members 226, 228 and 230 mounted to the shaft 224 at axially-spaced locations. A bearing 232 is mounted to the shaft 224 between the stiffener members 226 and 228, and a bearing 234 is mounted to the shaft 224 between the stiffener members 228 and 230. The bearings 232, 234 are spaced from each other along the shaft 224 by a distance, x. In embodiments, the distance x can be from about 50 mm to about 200 mm. In other embodiments, the fixing device 200 can include more than two bearings and more than three stiffener members mounted to the shaft 224.

A cylindrical outer sleeve 236 including the outer surface 222 of the second roll 220 is disposed over the stiffener members 226, 228 and 230 and the bearings 232, 234. In embodiments, the outer sleeve 236 is secured to the bearings 232, 234 and is non-movable in the axial direction of the second roll 220. The outer sleeve 236 has an outer diameter, $D_2$. The outer diameter $D_2$ can typically range from about 30 mm to about 100 mm. The outer sleeve 236 has a length, L, which can typically be about 200 mm to about 400 mm. In embodiments, the outer diameter $D_2$ can be constant along the length L of outer sleeve 236, i.e., the outer surface 222 is not profiled. In other embodiments, the outer surface 222 can be slightly profiled to provide fine wrinkle control. For example, the outer surface 222 can have a larger outer diameter extending toward the axial ends of the second roll 220. The inner diameter of the outer sleeve 236 can be constant along the length L.

The stiffener members 226, 228 and 230 can comprise any suitable material that provides the desired stiffness properties in the second roll 220, including metallic, ceramic, composite and polymeric materials. The stiffener members 226, 228 and 230 can maximize core stiffness without contacting the outer sleeve 236, to avoid excessive bending of the core. The stiffener members 226, 228 and 230 can be cylindrical shaped with an outer diameter $D_3$. In the second roll 220, the stiffener members 226, 228 and 230 can be as large as possible without contacting the outer sleeve 236 when the second roll 220 is loaded.

The outer sleeve 236 can comprise one or more suitable material selected from metallic, ceramic, composite and polymeric materials. For example, in embodiments of the fixing device 200 in which relatively high pressure is applied at the nip 250 (e.g., where the outer surface 222 of the second roll 220 and the outer surface 212 of the first roll 210 are not actively heated), the outer sleeve 236 and stiffener members 226, 228 and 230 can comprise a hard metal or ceramic material. In embodiments of the fixing device 200 in which lower pressures are applied at the nip 250, and the outer surface 222 of the second roll 220 is heated (and the outer surface 212 of the first roll 210 may also be heated), when heat and pressure are used to fix marking materials onto media at the nip 250, the outer sleeve 236 can comprise at least one elastically-deformable material, such as silicone rubber, or the like. The outer surface 222 can be heated, e.g., by one or more external heater rolls (not shown) contacting the outer surface 222, by radiation and/or by convection. A release layer can be provided on the elastically-deformable material(s) and form the outer surface 222 of the second roll 220.

The outer sleeve 236 has a wall thickness, t, in the radial direction of the second roll 220. The wall thickness t can typically vary from about 3 mm to about 12 mm. For a given material, increasing the wall thickness t of the outer sleeve 236 increases its rigidity (stiffness) and resistance to bending.

In embodiments, to assemble the second roll 220, each of the stiffener members 226, 228 and 230 can be attached to the shaft 224 to be rotatable with the shaft 224. The outer surface 222 of the outer sleeve 236 may be coated with elastomeric and/or release materials prior to assembly. The second roll 220 can be assembled by pressing the stiffener member 228 onto the shaft 224 at a centered position, pressing the bearings 232, 234 onto the shaft 224 to be flush with axial ends of the stiffener member 228, and then pressing the stiffener members 226, 230 onto the shaft 224 to be flush with the bearings 232, 234.

As shown, an annular gap, $G_1$, is formed between the stiffener member 226 and the sleeve 236; an annular gap, $G_2$, is formed between the between the stiffener member 228 and the sleeve 236; and an annular gap, G3, is formed between the stiffener member 230 and the sleeve 236. In the illustrated non-loaded state, each of the gaps $G_1$, $G_2$ and $G_3$ can have the same radial dimension. Typically, the gaps $G_1$, $G_2$ and $G_3$ can have a radial dimension of about 0.5 mm to about 5 mm. In embodiments, the radial dimension can be constant along each of the gaps $G_1$, $G_2$ and $G_3$. In other embodiments, one or more of the gaps $G_1$, $G_2$ and $G_3$ can be profiled (i.e., have a non-constant radial dimension) along its length to provide further tuning of axial pressure uniformity in the second roll 220. The gaps $G_1$, $G_2$ and $G_3$ are sufficiently large to allow the outer sleeve 236 to bend about the longitudinal axis without contacting the stiffener members 226, 228 and 230 when the first roll 210 and second roll 220 are loaded.

Figure 3:
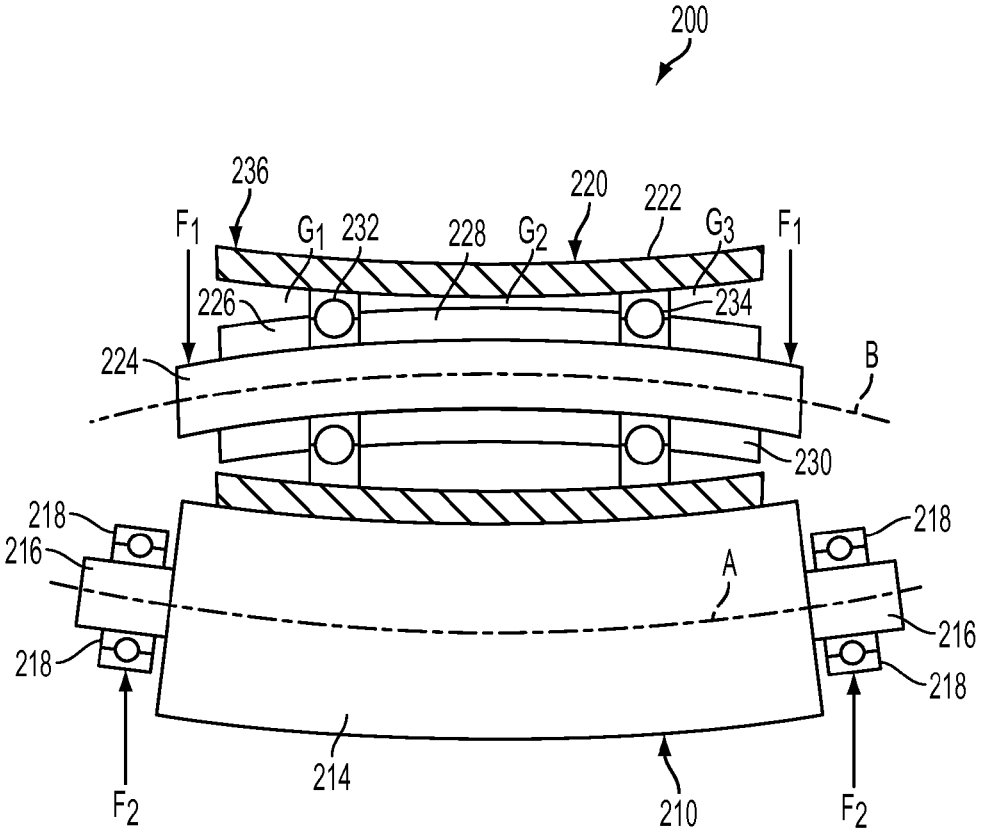
FIG. 3 depicts the fixing device shown in FIG. 2 with the rolls in a loaded state.

FIG. 3 depicts the fixing device 200 in a loaded state. As shown, force $F_1$ is applied to the shaft 224 of the second roll 220 and force $F_2$ is applied to the bearings 218 of the first roll 210. The force $F_1$ acts in an opposite direction to the force $F_2$. As shown, the forces $F_1$, $F_2$ cause the first roll 210 to bend about a longitudinal axis, A, and for portions of the second roll 220 to bend about a longitudinal axis, B, in opposite directions to each other. In the second roll 220, an inner portion, which includes the shaft 224 and stiffener members 226, 228 and 230, and the bearings 232, 234, bend in one direction while an outer portion including the outer sleeve 236 bends in an opposite direction. The outer sleeve 236 bends in the same direction as the first roll 210. This bending of the first roll 210 and second roll 220 avoids the standard "bow-tie" (i.e., small in the middle and large at the ends) nip profile and allows control of each of the major dimensions (x, y and z) in order to enhance, and desirably optimize, axial pressure and nip width uniformity.

In the fixing device 200, the diameter $D_2$ (and outer circumference) of the second roll 220 is substantially constant along the axial direction of the second roll 220 when the first roll 210 and the second roll 220 are loaded as shown in FIG. 3. The diameter $D_1$ (and outer circumference) of the first roll 210 also is substantially constant along the axial direction of the first roll 210 when in the loaded state. Consequently, the width of the nip 250 and the pressure distribution along the nip 250 in the axial direction are more uniform. In embodiments of the fixing device 200 in which the first roll 210 and the second roll 220 have hard outer surfaces 212, 222, respectively, and are not actively heated, media stress can be reduced, and desirably minimized, in the axial direction of the first roll 210 and the second roll 220 along the nip 250, and media wrinkling can be reduced, and desirably substantially avoided, by having a more constant velocity across the media width by the more uniform nip pressure distribution.

The distance x between the bearings 232, 234 can be increased or decreased by either increasing or decreasing, respectively, the axial length of the stiffener member 228, while also decreasing or increasing, respectively, the axial lengths of the stiffener members 226 and 230, which typically have the same length.

Figure 6:
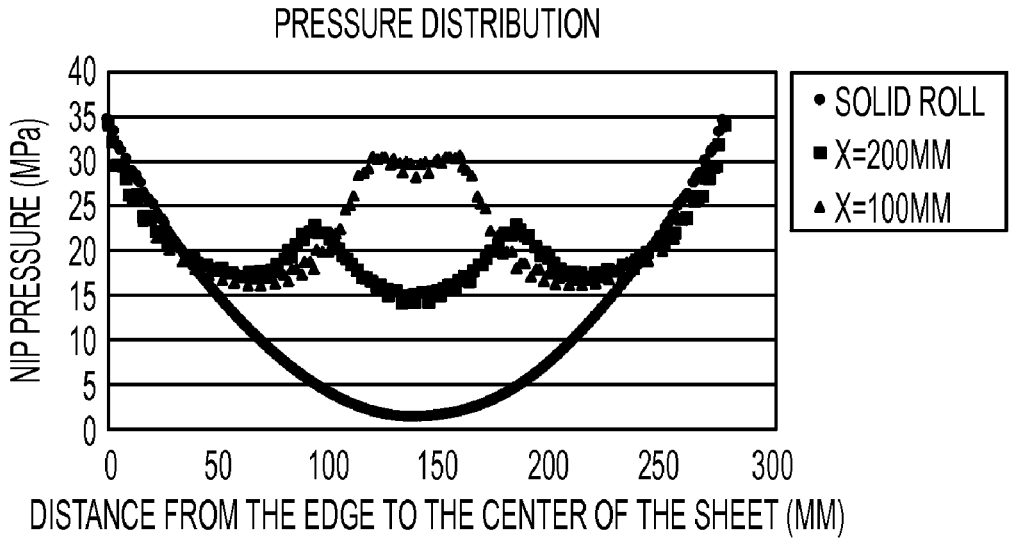
FIG. 6 shows plots of the nip pressure as a function of the distance from an edge to the center of a sheet fed to the nip for a solid roll and for fixing devices according to exemplary embodiments.

FIG. 6 shows plots of the nip pressure as a function of the distance from an edge (distance=0) to the center of a sheet in a fixing device that includes solid (hard) rolls having constant outer diameters along their lengths, and in a fixing device, such as the fixing device 200, including axially-spaced bearings mounted to a shaft and located between stiffener members and an outer sleeve, for an axial bearing spacing of 100 mm and 200 mm, respectively. As shown, for the solid roll fixing device, the nip pressure varies from 35 MPa at the left edge and right edge to only several MPa at the middle of the sheet.

In contrast, for the fixing devices including bearings having an axial spacing of 100 mm and 200 mm, the pressure distribution across the sheet width is significantly more uniform than in the solid roll fixing device. In embodiments, a bearing spacing of 100 mm (or less) may be more desirable than a larger spacing of 200 mm (or more) because the pressure at the middle portion of the sheet is closer to the pressure at the edges of the sheet. The most desirable bearing spacing in embodiments of the fixing device 200 can depend on factors including, e.g., media length, first roll 210 and second roll 220 lengths, total applied load, outer sleeve 236 thickness, and the construction materials of the first roll 210 and second roll 220.

In embodiments of the fixing device 200, the distance x between the bearings 232, 234 in the fixing device 200, can be selected to optimize the axial nip pressure uniformity for a given construction of the first roll 210 and second roll 220. The wall thickness t of the outer sleeve 236 can also be increased to increase the rigidity of the outer sleeve 236 and nip pressure uniformity along the roll axis.

Figure 4:
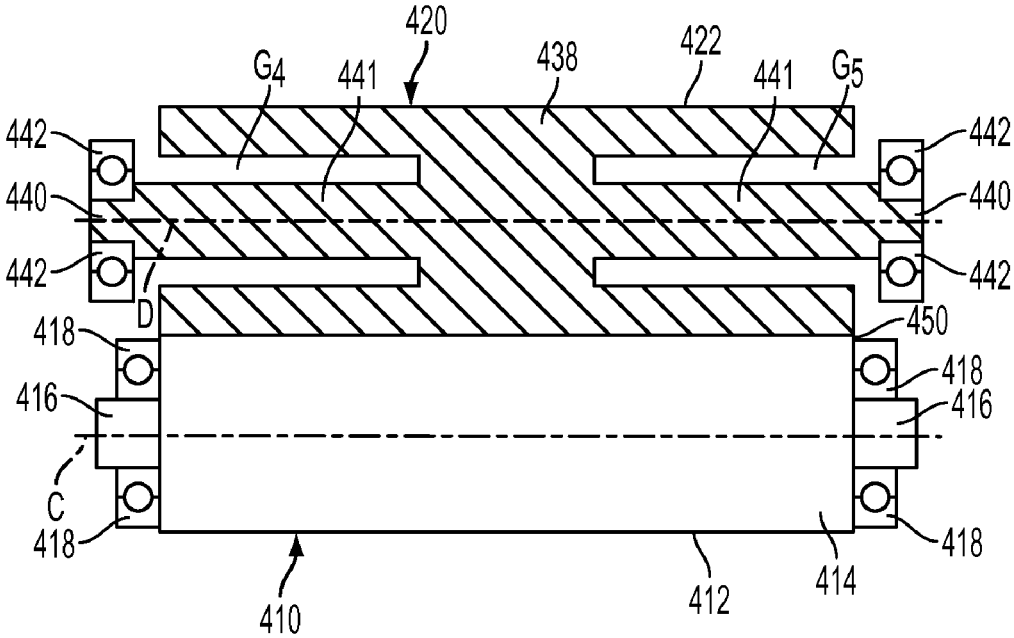
FIG. 4 depicts another exemplary embodiment of an apparatus useful in printing including a fixing device with rolls.

FIG. 4 illustrates another exemplary embodiment of an apparatus useful in printing including a fixing device 400. The fixing device 400 includes a first roll 410 and a second roll 420 (shown in cross-section). In embodiments, the first roll 410 is the drive roll and the second roll 420 is driven by contact with the first roll 410 and media. The first roll 410 includes an outer surface 412 and the second roll 420 includes an outer surface 422. The outer surfaces 412, 422 form a nip 450 to which media are fed to fix marking material onto the media. FIG. 4 depicts the fixing device 400 from a direction substantially along the process direction of media fed to the nip 450. FIG. 4 shows the first roll 410 and the second roll 420 in an un-loaded state.

In embodiments, the first roll 410 can, e.g., have the same construction as embodiments of the first roll 210 of the fixing device 200. The first roll 410 can be either a non-conformable roll (i.e., hard roll), or a conformable roll. The first roll includes a body 414 and a shaft including journals 416. In embodiments, the body 414 is cylindrical shaped. The outer diameter of the body 414 can be constant along the axial length of outer surface 412. A bearing 418 is mounted to each respective journal 416. The first roll 410 is supported (loaded) in the fixing device 400 by forces applied at the journals 418.

Embodiments of the fixing device 400 may not include an internal or external thermal energy source that actively heats the outer surface 412 of the first roll 410. In other embodiments of the fixing device 400, the first roll 410 can be internally and/or externally heated. For example the first roll 410 can include one or more internal heating elements (not shown), or alternatively, or additionally, can be externally heated by any suitable thermal energy source(s).

In embodiments, the second roll 420 can be made of a single piece of material. The material can be selected from metals, ceramics, polymers and composites. For example, the material can be a metal or ceramic casting, or a molded polymer. In embodiments of the fixing device 400 in which high pressure is applied at the nip 450 (e.g., the outer surface 422 of the second roll 420 and the outer surface 412 of the first roll 410 are not actively heated), the second roll 420 can be comprised of a hard metal or ceramic material. In embodiments of the fixing device 400 in which lower pressures are applied at the nip 450 and the outer surface 422 of the second roll 420 is actively heated (and the outer surface 412 of the first roll 410 may optionally also be actively heated) to fix marking materials onto media at the nip 450 with heat and pressure, the second roll 420 can be comprised an elastically-deformable material, such as silicone rubber, or the like. A release layer can be provided on the elastically-deformable material and form the outer surface 422 of the second roll 420.

The second roll 420 includes journals 440 at opposite ends of an inner portion forming a shaft 441. Bearings 442 are mounted to the journals 440.

As shown, annular gaps, $G_4$ and $G_5$, are formed between the shaft 441 and the outer portion of the second roll 420. In the illustrated non-loaded state, the gaps $G_4$ and $G_5$ can have the same radial dimension. Typically, the gaps $G_4$ and $G_5$ can have a radial dimension of about 0.5 mm to about 5 mm. In embodiments, the radial dimension can be constant axially along each of the gaps $G_4$ and $G_5$. In other embodiments, the gaps $G_4$ and $G_5$ can be profiled (i.e., have a non-constant radial dimension) along their lengths to provide further tuning of axial pressure uniformity in the second roll 420. The gaps $G_4$ and $G_5$ are sufficiently large to allow the outer portion of the second roll 420 overlying the gaps $G_4$ and $G_5$ to bend and remain separated from the shaft 441 when the first roll 410 and second roll 420 are loaded (FIG. 5).

Typically, the gaps $G_4$ and $G_5$ can have a length of about ¼ to less than ½ of the length of the second roll 420. In embodiments, the axial lengths of the gaps $G_4$ and $G_5$ can be selected to optimize the axial pressure distribution along the nip 450 depending on other parameters of the second roll 420, while minimizing weight and stress concentrations in the second roll 420.

Figure 5:
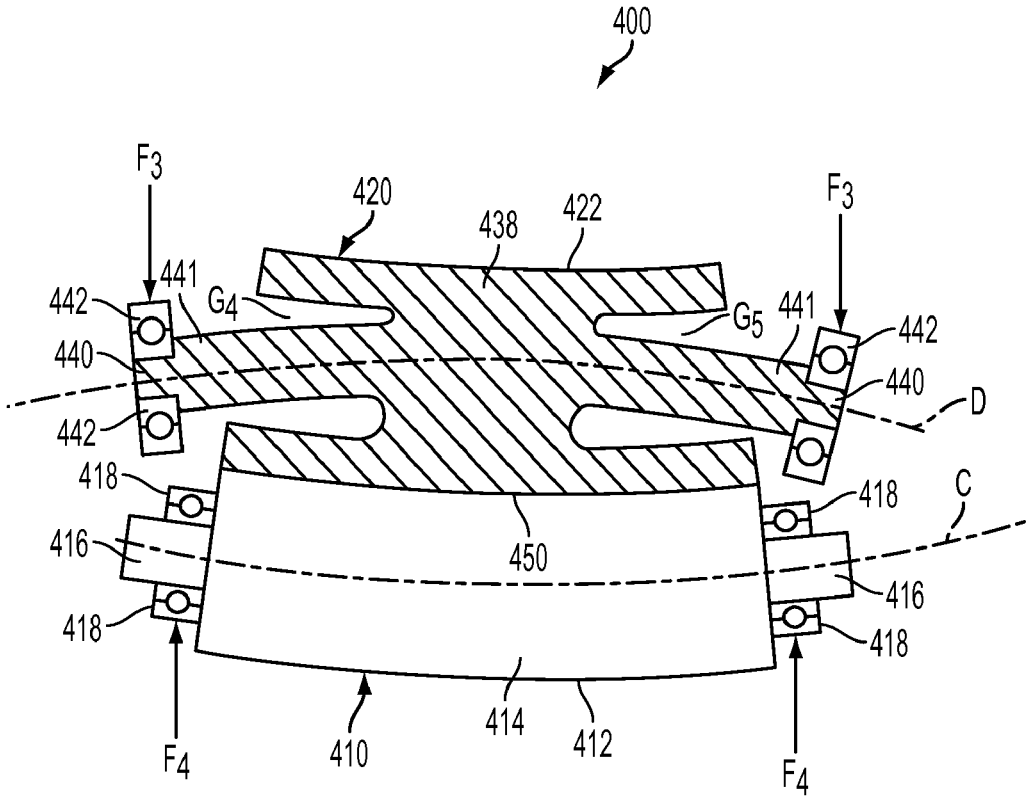
FIG. 5 depicts the fixing device shown in FIG. 4 with the rolls in a loaded state.

FIG. 5 depicts the fixing device 400 in a loaded state, in which a force $F_3$ is applied to the shaft 441 of the second roll 420 and a force $F_4$ is applied to the bearings 418 of the first roll 410. The force $F_3$ acts in an opposite direction to the force $F_4$. As shown, the forces $F_3$ and $F_4$ cause the first roll 410 to bend about a longitudinal axis, C, and portions of the second roll 420 to bend about a longitudinal axis, D, in an opposite direction to that of the first roll 410. In the second roll 420, the inner portion including the shaft 441 bends in one direction, while the outer portion outward from the shaft 441 bends in an opposite direction, which is same direction that the first roll 410 bends. This bending of the first roll 410 and second roll 420 avoids a "bow-tie" nip profile and allows enhanced, and desirably optimized, axial pressure and nip width uniformity.

In the fixing device 400, the outer diameters (and outer circumferences) of the first roll 410 and second roll 420 are substantially constant along the axial directions of the first roll 410 and second roll 420 when un-loaded (FIG. 4) and when loaded (FIG. 5). Consequently, the width of the nip 450 and the pressure distribution along the nip 450 in the axial direction can be more uniform. In embodiments of the fixing device 400 in which the first roll 410 and the second roll 420 have hard outer surfaces 412, 422, respectively, and are not actively heated, media stress can be reduced, and desirably minimized, in the axial direction of the first roll 410 and the second roll 420 along the nip 450, and media wrinkling can be reduced, and desirably substantially avoided, by the more uniform nip pressure distribution.

It will be understood that the teachings and claims herein can be applied to any treatment of marking material on media. For example, the marking material can be comprised of toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing, for example.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful in printing, comprising:

a first roll comprising a first shaft and a first surface;

a second roll comprising:

an axially-extending inner portion including a second shaft;

an axially-extending outer portion over the inner portion;

at least a first annular gap and a second annular gap extending axially between the inner portion and the outer portion, the first annular gap being axially spaced from the second annular gap; and a second surface forming a nip with the first surface;

wherein the inner portion and the outer portion of the second roll bend in opposite directions when the first roll and the second roll are loaded by applying a first force to the first shaft in a first direction and applying a second force to the second shaft in a second direction opposite to the first direction, and wherein the inner portion and the outer portion of the second roll are comprised of a single piece of material selected from the group consisting of metals, ceramics, polymers and composites, the inner portion of the second roll including a first journal at a first end of the second shaft and a second journal at a second end of the second shaft, and the second force is applied at the first journal and second journal.

2. The apparatus of claim 1, wherein the inner portion of the second rolls bends in an opposite direction to the first roll, and the outer portion of the second roll bends in the same direction as the first roll when loaded.

3. The apparatus of claim 1, wherein the first roll and the second roll have a substantially constant outer diameter along a length of the first roll and a length of the second roll when loaded.

4. The apparatus of claim 1, wherein:

the second shaft comprises a first end and a second end;

the inner portion comprises a first stiffener member mounted to the second shaft between the first end and second end, a second stiffener member mounted to the second shaft between the first stiffener member and the second end, and a third stiffener member mounted to the second shaft between the second stiffener member and the second end;

a first bearing is mounted to the second shaft between the first stiffener member and the second stiffener member;

a second bearing is mounted to the second shaft between the second stiffener member and the third stiffener member;

the outer portion comprises an outer sleeve supported on the first bearing and the second bearing;

the first annular gap is between the first stiffener member and the outer sleeve;

the second annular gap is between the second stiffener member and the outer sleeve; and a third annular gap is between the third stiffener member and the outer sleeve; and the outer sleeve does not contact the first stiffener member, second stiffener member or the third stiffener member with the first roll and second roll are loaded.

5. The apparatus of claim 4, wherein:

the second roll has a length of about 200 mm to about 400 mm; and the first bearing is spaced from the second bearing by a distance of about 50 mm to about 200 mm.

6. The apparatus of claim 1, wherein the apparatus does not include a thermal energy source that actively heats the first surface of the first roll or the second surface of the second roll and the first roll and second roll are adapted to apply pressure to a medium received at the nip.

7. An apparatus useful in printing, comprising:

a first roll comprising a first shaft and a first surface;

a second roll comprising:

a second shaft including a first end and a second end;

at least a first bearing and a second bearing mounted to the second shaft at axially spaced locations between the first end and second end;

an outer sleeve overlying the second shaft and supported by the first bearing and second bearing;

at least a first annular gap and a second annular gap extending axially between the second shaft and the outer sleeve, the second annular gap being axially spaced from the first annular gap; and a second surface forming a nip with the first surface;

wherein the second shaft and the outer sleeve bend in opposite directions when the first roll and the second roll are loaded by applying a first force to the first shaft in a first direction and applying a second force to the second shaft in a second direction opposite to the first direction, the second shaft including a first journal at a first end and a second journal at a second end of the second shaft, and the second force is applied at the first journal and second journal.

8. The apparatus of claim 7, wherein the first roll and the second roll have a substantially constant outer diameter along a length of the first roll and a length of the second roll when loaded.

9. The apparatus of claim 7, wherein:

the second shaft comprises a first end and a second end;

a first stiffener member is mounted to the second shaft between the first end and second end, a second stiffener member is mounted to the second shaft between the first stiffener member and the second end, and a third stiffener member is mounted to the second shaft between the second stiffener member and the second end;

the first bearing is mounted to the second shaft between the first stiffener member and the second stiffener member;

the second bearing is mounted to the second shaft between the second stiffener member and the third stiffener member;

the sleeve is supported on the first bearing and the second bearing;

the first annular gap is between the first stiffener member and the sleeve;

the second annular gap is between the second stiffener member and the sleeve; and a third annular gap is between the third stiffener member and the sleeve;

wherein the second shaft, first stiffener member, second stiffener member, third stiffener member, first bearing and second bearing bend in an opposite direction to the first roll, and the outer sleeve of the second roll bends in the same direction as the first roll when the first roll and second roll are loaded.

10. The apparatus of claim 7, wherein:

the second roll has a length of about 200 mm to about 400 mm; and the first bearing is spaced from the second bearing by a distance of about 50 mm to about 200 mm.

11. The apparatus of claim 7, wherein the apparatus does not include a thermal energy source that actively heats the first surface of the first roll or the second surface of the second roll and the first roll and second roll are adapted to apply pressure to a medium received at the nip.

12. A method of fixing a marking material onto a medium in an apparatus useful in printing, the apparatus comprising a first roll comprising a first shaft and a first surface, a second roll comprising an axially-extending inner portion including a second shaft, an axially-extending outer portion over the inner portion, at least a first annular gap and a second annular gap extending axially between the inner portion and the outer portion, the first annular gap being axially spaced from the second annular gap, and a second surface forming a nip with the first surface, the method comprising:

loading the first roll and the second roll by applying a first force to the first shaft in a first direction and applying a second force to the second shaft in a second direction opposite to the first direction, wherein the inner portion and the outer portion of the second roll bend in opposite directions; and feeding a medium having marking material thereon to the nip of the apparatus and fixing the marking material onto the medium, wherein the inner portion and the outer portion of the second roll are comprised of a single piece of material selected from the group consisting of metals, ceramics, polymers and composites, the inner portion of the second roll including a first journal at a first end of the second shaft and a second journal at a second end of the second shaft, and the second force is applied at the first journal and second journal.

13. The method of claim 12, wherein the inner portion of the second rolls bends in an opposite direction to the first roll, and the outer portion of the second roll bends in the same direction as the first roll when the first roll and second roll are loaded.

14. The method of claim 12, wherein the first roll and the second roll have a substantially constant outer diameter along a length of the first roll and a length of the second roll when loaded.

15. The method of claim 12, wherein:

the second shaft comprises a first end and a second end;

the inner portion comprises a first stiffener member mounted to the second shaft between the first end and second end, a second stiffener member mounted to the second shaft between the first stiffener member and the second end, and a third stiffener member mounted to the second shaft between the second stiffener member and the second end;

a first bearing is mounted to the second shaft between the first stiffener member and the second stiffener member;

a second bearing is mounted to the second shaft between the second stiffener member and the third stiffener member;

the outer portion comprises an outer sleeve supported on the first bearing and the second bearing;

the first annular gap is between the first stiffener member and the outer sleeve;

the second annular gap is between the second stiffener member and the outer sleeve; and a third annular gap is between the third stiffener member and the outer sleeve; and the outer sleeve does not contact the first stiffener member, second stiffener member or the third stiffener member with the first roll and second roll are loaded.

16. The method of claim 12, wherein the first surface of the first roll and the second surface of the second roll are not heated by a thermal energy source and the first roll and second roll apply pressure to the medium at the nip to fix the marking material onto the medium.

* * * * *